US009470454B2

(12) United States Patent
Varro

(10) Patent No.: US 9,470,454 B2
(45) Date of Patent: Oct. 18, 2016

(54) COLLAPSIBLE AERATION SYSTEM FOR RETROFITTING A GRAIN BIN

(71) Applicant: Imre Varro, Lethbridge (CA)

(72) Inventor: Imre Varro, Lethbridge (CA)

(73) Assignee: AG Growth International Inc., Winnipeg, Manitoba (CA)

( * ) Notice: Subject to any disclaimer, the term of this patent is extended or adjusted under 35 U.S.C. 154(b) by 116 days.

(21) Appl. No.: 14/334,124

(22) Filed: Jul. 17, 2014

(65) Prior Publication Data

US 2014/0325864 A1 Nov. 6, 2014

Related U.S. Application Data

(63) Continuation of application No. 12/938,940, filed on Nov. 3, 2010, now Pat. No. 8,793,891.

(51) Int. Cl.

| | |
|---|---|
| ***F26B 19/00*** | (2006.01) |
| ***F26B 21/00*** | (2006.01) |
| ***F26B 17/14*** | (2006.01) |
| ***F26B 25/10*** | (2006.01) |

(52) U.S. Cl.

CPC ..... *F26B 21/004* (2013.01); *F26B 17/1408* (2013.01); *F26B 25/10* (2013.01); *Y10T 29/49716* (2015.01)

(58) Field of Classification Search

CPC ..... F26B 19/00; F26B 21/00; F26B 21/06; Y10T 29/00; Y10T 29/49716; A01B 12/00; A01B 12/006

USPC ..... 34/168, 218; 56/202, 203; 15/339, 15/340.1; 280/460.1, 656

See application file for complete search history.

(56) References Cited

U.S. PATENT DOCUMENTS

| | | | | |
|---|---|---|---|---|
| 3,984,893 | A | 10/1976 | Ashley | |
| 4,086,708 | A | 5/1978 | Westelaken | |
| 4,337,584 | A * | 7/1982 | Johnson | F26B 17/124 34/169 |
| 4,423,557 | A * | 1/1984 | Westelaken | F26B 25/002 34/167 |
| 4,699,393 | A | 10/1987 | Schweigert | |
| 4,754,557 | A | 7/1988 | Anderson | |
| 5,218,737 | A | 6/1993 | Dansby et al. | |
| 5,291,722 | A | 3/1994 | Schweigert | |
| 5,592,750 | A | 1/1997 | Eichten | |
| 6,029,312 | A | 2/2000 | Whitney | |
| 6,202,319 | B1 * | 3/2001 | Bening | F26B 17/122 34/165 |

(Continued)

FOREIGN PATENT DOCUMENTS

| | | |
|---|---|---|
| CA | 2744311 | 2/2012 |
| DE | 4105805 | 8/1992 |

(Continued)

*Primary Examiner* — Stephen M Gravini

(74) *Attorney, Agent, or Firm* — O'Shea Getz P.C.

(57) ABSTRACT

A novel collapsible aeration system is retrofitted into a grain bin with a discharge opening in the bottom. This grain bin may have a sloped or conical hopper or a flat bottom. The aeration system is formed from a set of connected (e.g. hinged) duct sections that define a round or multi-sided duct having a minimum of three sides or faces. The sides may be flat, curved or corrugated. The collapsible aeration system is folded (collapsed), inserted into the bin via a hole, and then unfolded inside the bin. An air duct is connected to the aeration system to enable the aeration system to dry the grain in the grain bin. This technology enables existing grain bins to be retrofitted with a dryer in an easy and efficient manner.

20 Claims, 10 Drawing Sheets

(56) References Cited

U.S. PATENT DOCUMENTS

| | | | | |
|---|---|---|---|---|
| 6,308,375 | B1 | 10/2001 | Whitney | |
| 6,658,833 | B2 | 12/2003 | Dunning et al. | |
| 6,701,679 | B2 | 3/2004 | Zazula et al. | |
| 7,568,297 | B2 | 8/2009 | Pierson | |
| 8,393,039 | B2 | 3/2013 | Johnson et al. | |
| 8,429,887 | B2 | 4/2013 | Sadler | |
| 8,793,891 | B2 * | 8/2014 | Varro | F26B 17/1408 15/340.1 |
| 2007/0234587 | A1 | 10/2007 | MacDonald et al. | |
| 2012/0102776 | A1 | 5/2012 | Varro | |
| 2014/0325864 | A1 * | 11/2014 | Varro | F26B 17/1408 34/168 |

FOREIGN PATENT DOCUMENTS

| | | |
|---|---|---|
| GB | 2096877 | 10/1982 |
| GB | 2118915 | 11/1983 |
| JP | 2012093024 | 5/2012 |
| MX | 2012008054 | * 8/2012 |
| UA | 9085 | 9/2005 |
| WO | 2007063402 | 6/2007 |

* cited by examiner

COLLAPSIBLE AERATION SYSTEM FOR RETROFITTING A GRAIN BIN

This application is a continuation of U.S. patent application Ser. No. 12/938,940 filed Nov. 3, 2010.

BACKGROUND OF THE INVENTION

1. Technical Field

The present invention relates generally to grain bins and, more particularly, to aeration systems or dryers for drying grain in a hopper associated with a grain bin.

2. Background Information

It is known in the art that grain stored in grain bins should be dried. However, many existing grain bins do not have a dryer or aeration system, leaving users the choice to either replace (at substantial cost) the grain bin with a newer model with an integral dryer or retrofit an existing grain bin with a dryer or aeration system. As will be appreciated by those of ordinary skill in the art, retrofitting a grain bin can be a challenge.

One technique for retrofitting an existing grain bin with an aeration system or dryer is to lower the aeration system into the hopper from the top of the grain bin. Because of the height of the grain bin, this can be a difficult task. This technique is disclosed in U.S. Pat. No. 4,754,557 and corresponding Canadian Patent 1,251,038 both of which are entitled "Grain Dryer". These patents disclose a grain dryer having an inner and outer vertically positioned concentric cylindrical members. This grain dryer is adapted for use in a hopper-bottomed grain bin for mounting over the aperture in the conical bottom of the grain bin. However, this grain dryer must be initially constructed within the grain bin when the grain bin is fabricated or it must be lowered into the grain bin via an opening in the roof of the bin. However, retrofitting an existing grain bin that lacks a dryer by lowering the dryer from the top of the grain bin is an arduous task.

Another technique is to insert components of the aeration system or dryer from the bottom discharge hole, manhole or any other aperture in the grain bin. The components are then assembled inside the grain bin or hopper. The downside of this technique is that it requires that one or more workers assemble the aeration system inside the hopper, which is time consuming and potentially unpleasant for the worker(s).

In view of the shortcomings of the above-mentioned prior art technologies, an improvement would thus be highly desirable.

SUMMARY OF THE DISCLOSURE

The present invention provides, in general, a novel collapsible aeration system for drying grain. This collapsible aeration system is made of multiple duct sections that are pivotally connected to one another. These duct sections enable the collapsible aeration system to be folded for insertion through a manhole or other access hole into a hopper where it can then be unfolded for use in drying grain stored within the grain bin. The aeration system thus permits an existing grain bin to be retrofitted with a grain dryer. In operation, the collapsible aeration system is connected to a fan via an air duct. Air is forced into the aeration system and out openings (e.g. louvers, perforations, lanced openings, etc.) in the duct sections for drying the grain. The aeration system is supported above the discharge chute of the hopper by a plurality of legs with pivotally connected feet that rest on the sloped inner surface of the hopper.

In accordance with one main aspect of the present invention, a collapsible aeration system for retrofitting a grain bin includes a plurality of connected duct sections. Each duct section has an outer surface, an inner surface narrower than the outer surface, and a pair of angled surfaces connecting the inner and outer surfaces. The duct sections each define an internal air space. The collapsible aeration system also includes a plurality of pivoting connections along adjoining edges of the duct sections for pivotally connecting adjacent pairs of the duct sections to thereby enable the collapsible aeration system to be folded and unfolded.

In accordance with another main aspect of the present invention, a method for retrofitting a hopper of a grain bin with an aeration system entails folding a collapsible aeration system, inserting the collapsible aeration system in a folded condition into the hopper via a hole in the hopper, and unfolding the collapsible aeration system inside the hopper.

In accordance with yet another main aspect of the present invention, an aeration system for retrofitting a grain bin includes a plurality of duct sections adapted to be connected together, each duct section having an outer surface, an inner surface narrower than the outer surface, and a pair of angled surfaces connecting the inner and outer surfaces, the duct sections. each defining an internal air space.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION OF THE INVENTION

The present invention is directed to a novel collapsible aeration system or grain dryer for retrofitting an existing grain bin that lacks an aeration system (dryer). This collapsible or foldable aeration system (dryer) may be folded for inserting through an opening in the bin. Once inside the hopper, the aeration system can be easily unfolded for use in drying the grain inside the grain bin.

Embodiments of this invention will now be described with reference to the appended figures.

Figure 1:
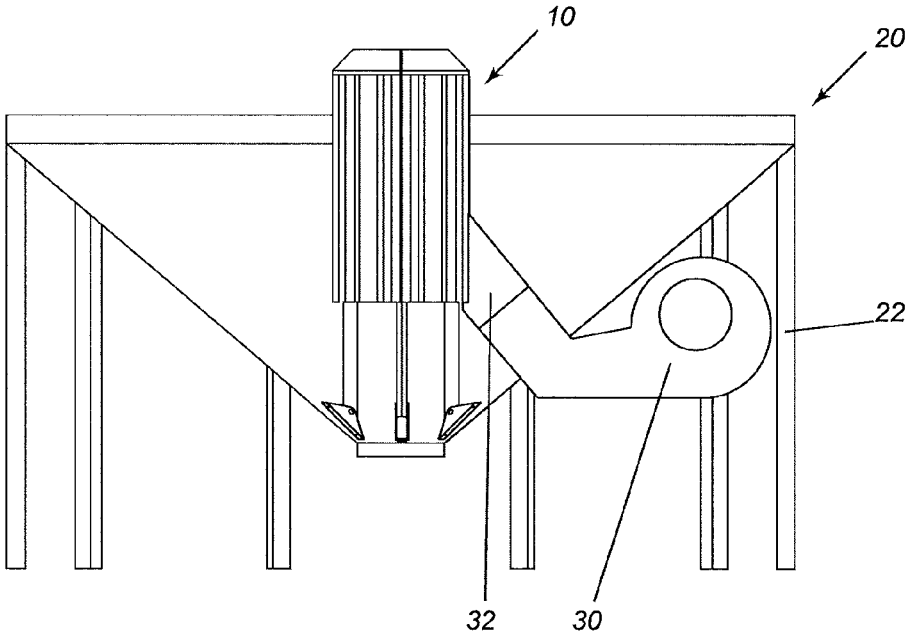
FIG. 1 is a front cross-sectional view of a collapsible aeration system installed within a hopper of a grain bin in accordance with an embodiment of the present invention.

FIG. 1 is a front cross-sectional view of a collapsible aeration system, which is generally designated by reference numeral 10, in accordance with one embodiment of the present invention. This collapsible aeration system 10 is installed within a hopper 20 of a grain bin. The hopper is supported by a plurality of struts or legs 22. A fan 30 is connected to the aeration system 10 by an air duct 32.

Figure 2:
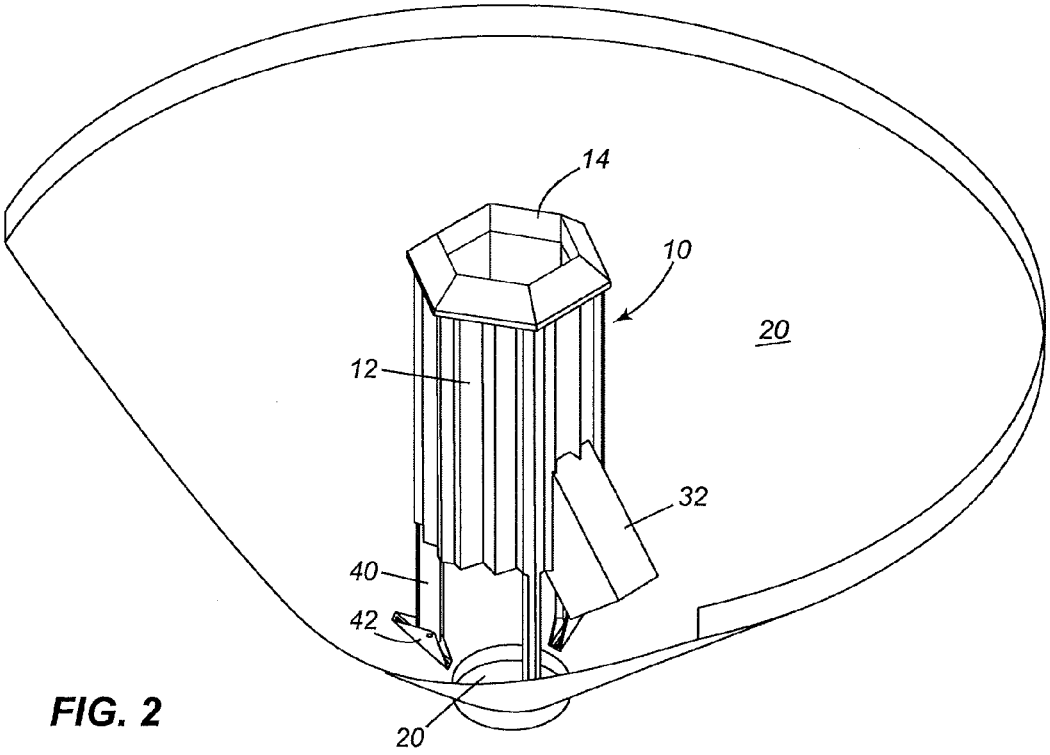
FIG. 2 is a perspective view of the collapsible aeration system inside the hopper.

FIG. 2 is a perspective view of the collapsible aeration system 10 introduced in FIG. 1. In this particular embodiment, the outer surfaces of the duct sections 12 are corrugated. As will be appreciated, other duct shapes such as curved or rounded may be employed. The duct sections 12 are capped by an air manifold 14 for circulating the air through the duct sections. A plurality of legs 40 support the collapsible aeration system above the discharge chute 24 (through which the grain exits from the hopper 20). The legs 40 may include, as shown by way of example in this figure, pivotally connected feet for resting on the sloped inner surface of the hopper 20.

Figure 3:
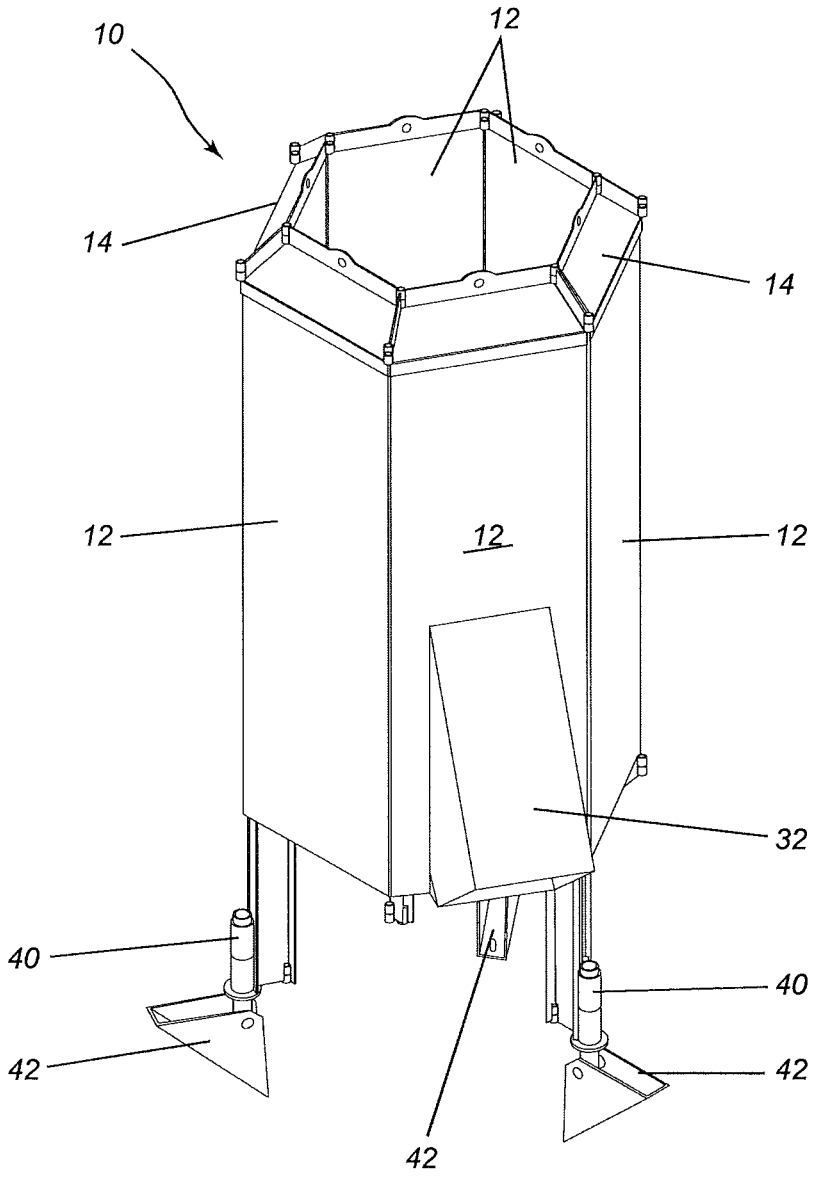
FIG. 3 is a perspective view of the collapsible aeration system having flat (non-corrugated) panels in accordance with another embodiment of the present invention.

FIG. 3 is a perspective view of the collapsible aeration system 10 having flat (non-corrugated) outer surfaces or panels in accordance with another embodiment of the present invention. The duct sections 12 (also referred to herein as ducts or channels) have multiple surfaces (sides) that together define an internal airspace. These may be, for example, trapezoidal duct sections with the outer and inner faces being parallel. In such an embodiment, the outer surface is wider than the inner surface. The two side surfaces slope at the same angle in the exemplary embodiments shown in this application. As will be explained in greater detail below, the ducts are pivotally connected or hinged alternately at the inner and outer edges so that the entire structure can be folded (collapsed) into a very compact configuration that can be inserted through a manhole or other access hole in the hopper. Folding the structure enables it to be inserted through a small hole through which it would otherwise not fit.

Figure 4:
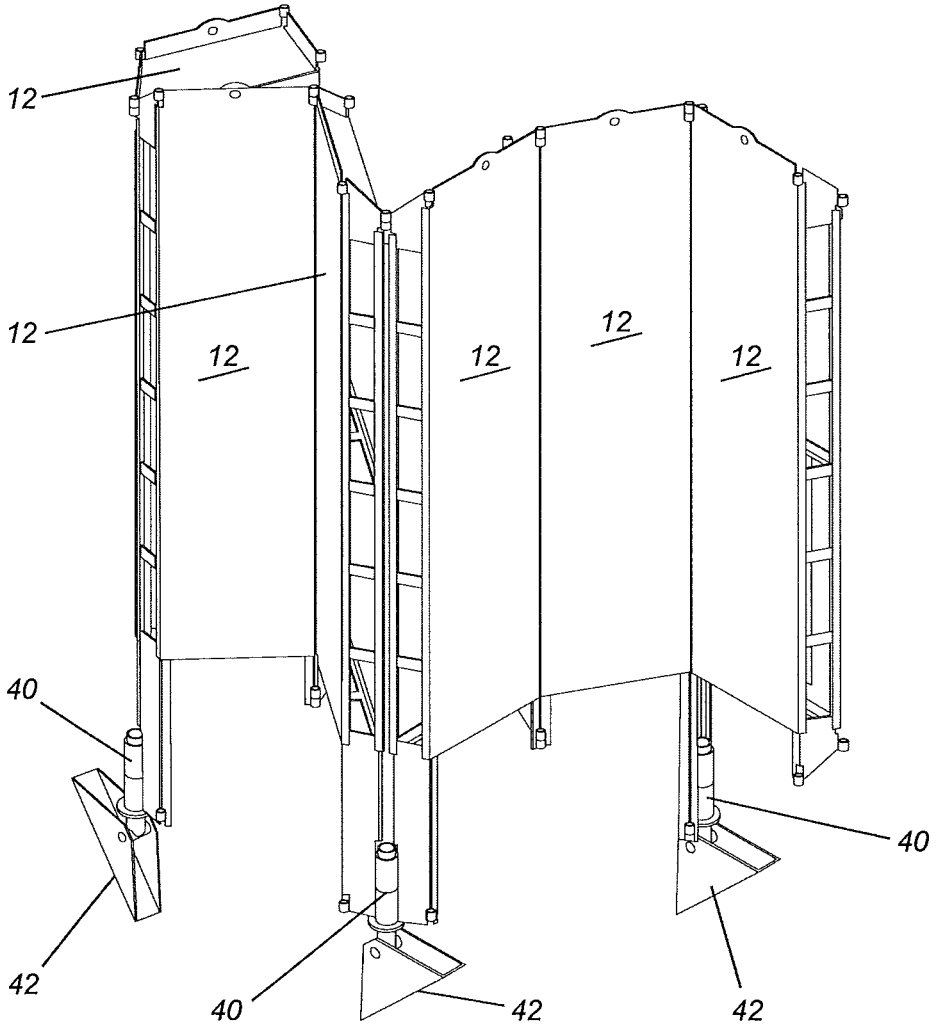
FIG. 4 is a perspective view of the partially folded collapsible aeration system.

FIG. 4 is a perspective view of the partially folded collapsible aeration system 10 of FIG. 3. The collapsible aeration system can be folded and unfolded easily and quickly because it is not use any threaded fasteners to hold it together.

Figure 5:
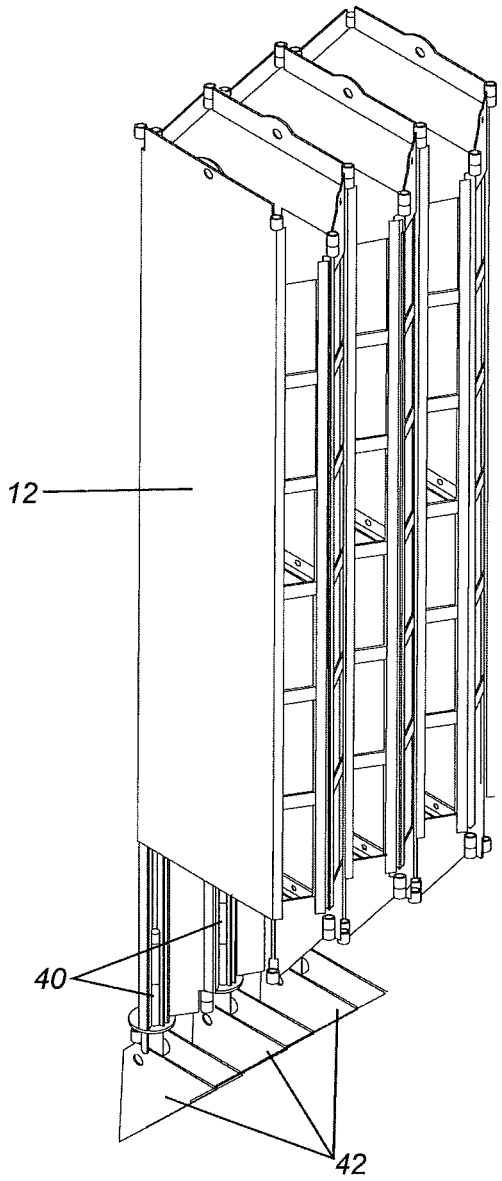
FIG. 5 is a perspective view of the fully folded collapsible aeration system.

FIG. 5 is a perspective view of the fully folded collapsible aeration system 10 of FIG. 3. The fully folded aeration system 10 is compact enough to be fitted through a manhole or other access hole in the hopper.

Figure 6:
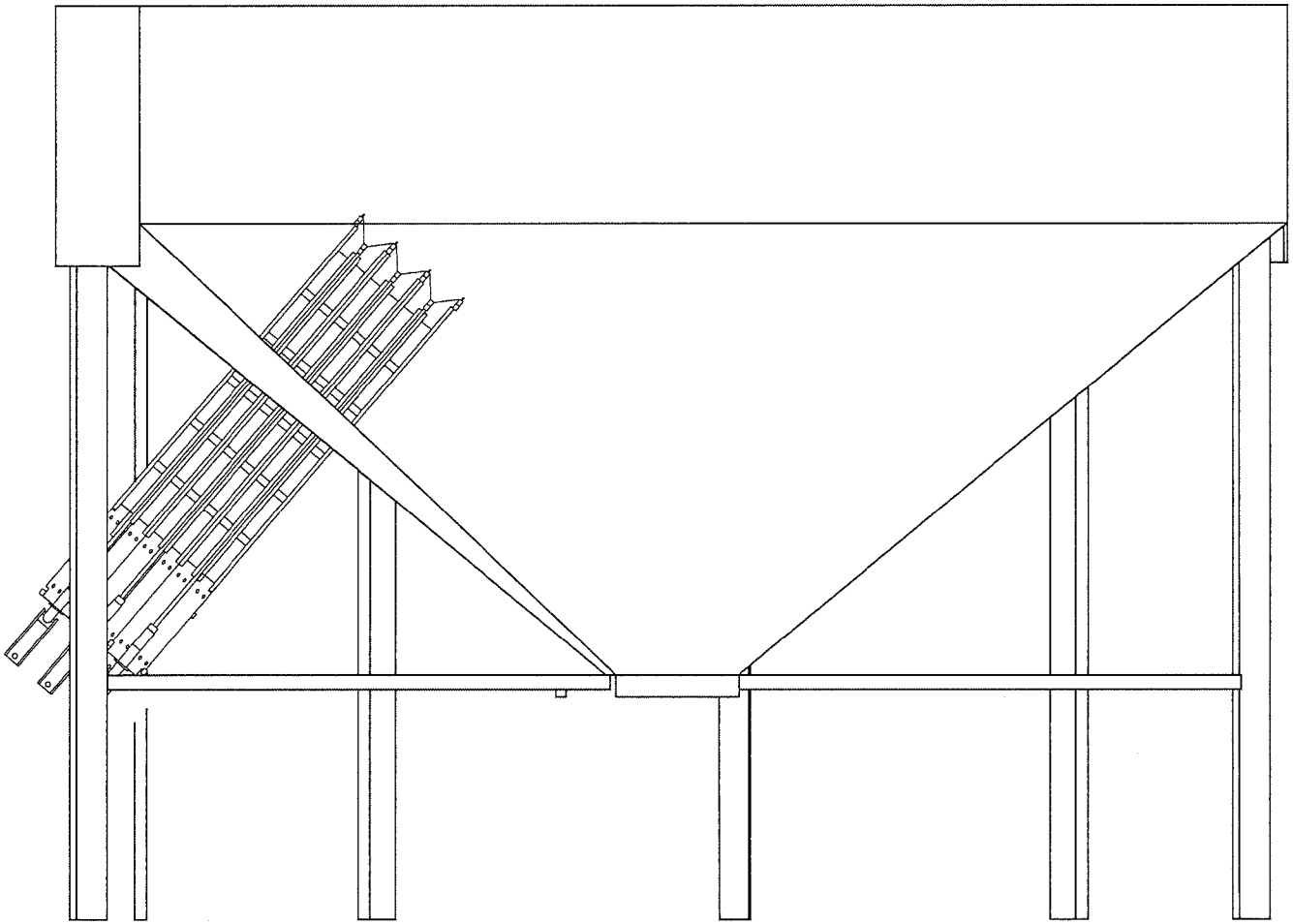
FIG. 6 is a partial cutaway view depicting how the folded collapsible aeration system is inserted through a manhole or other access hole in the hopper for subsequent unfolding and installation inside the hopper.

FIG. 6 is a partial cutaway view depicting how the folded collapsible aeration system 10 is easily inserted through a manhole 21 or other access hole in the hopper 20 for subsequent unfolding and installation inside the hopper. Inserting the collapsible aeration system 10 the manhole is much easier, quicker and safer than attempting to lower an aeration system from the top of the grain bin, as has been done conventionally. Grain bins typically have a wall height of over 10 feet (3 m) which requires a hoist or winch system to raise and lower the retrofit aeration system into the grain bin.

Figure 7:
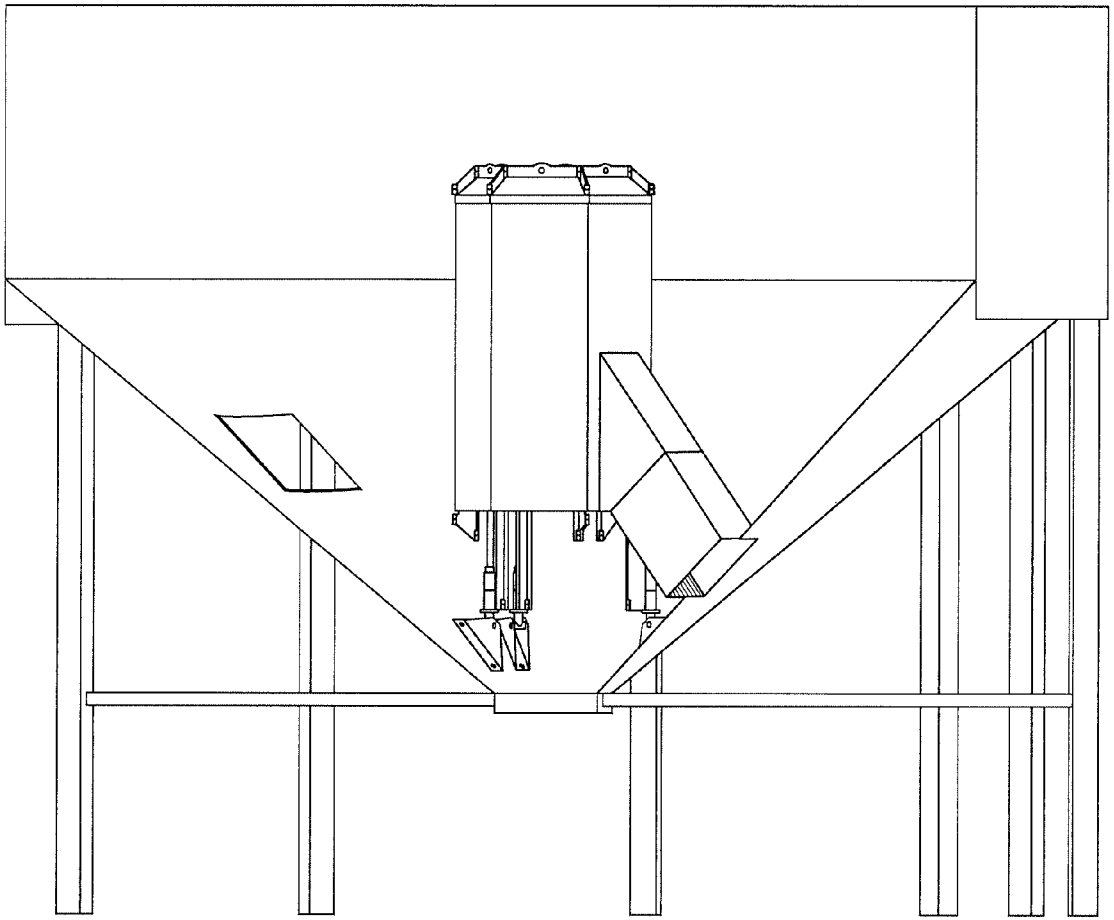
FIG. 7 is a partial cutaway perspective view of the collapsible aeration system installed inside the hopper.

FIG. 7 is a partial cutaway perspective view of the collapsible aeration system 10 installed inside the hopper 20 after it has been inserted through the manhole 21. Above the hopper is a grain bin 25. The arrangement of the hopper and grain bin is well known in the art and thus will not be described. FIG. 7 shows by way of example how the feet 42 of the supporting legs 40 pivot to rest on the sloped inner surface of the hopper 20.

Figure 8:
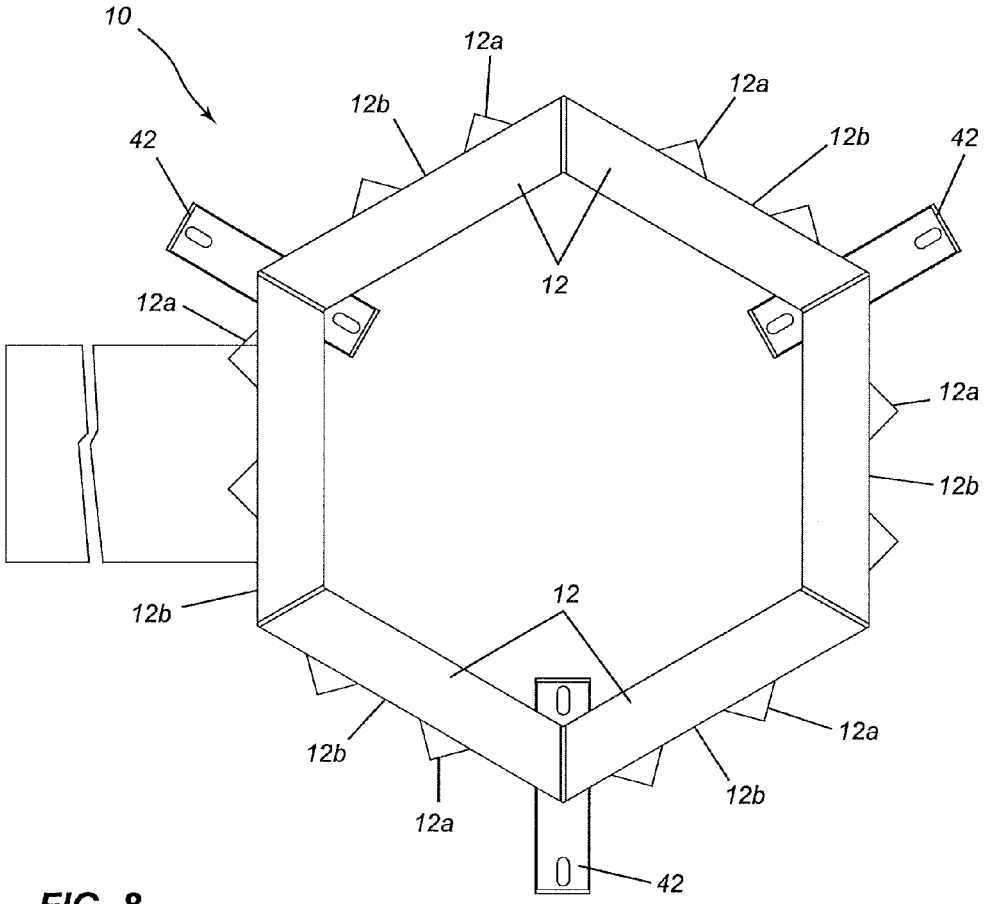
FIG. 8 is a top plan view of a six-sided collapsible aeration system.

FIG. 8 is a top plan view of a six-sided collapsible aeration system 10 in accordance with one embodiment of the present invention. The aeration system 10 has six ducts (or duct sections) 12. The outer surfaces of the duct sections may be corrugated 12*a* or flat 12*b*. In the embodiment where the duct sections are corrugated, the duct sections form trapezoidal ducts or channels. In this particular embodiment, there are three legs and three feet 42 for supporting the aeration system in the hopper. One of the duct sections has, or is adapted to receive, an air duct 32, as shown by way of example in this figure.

Figure 9A:
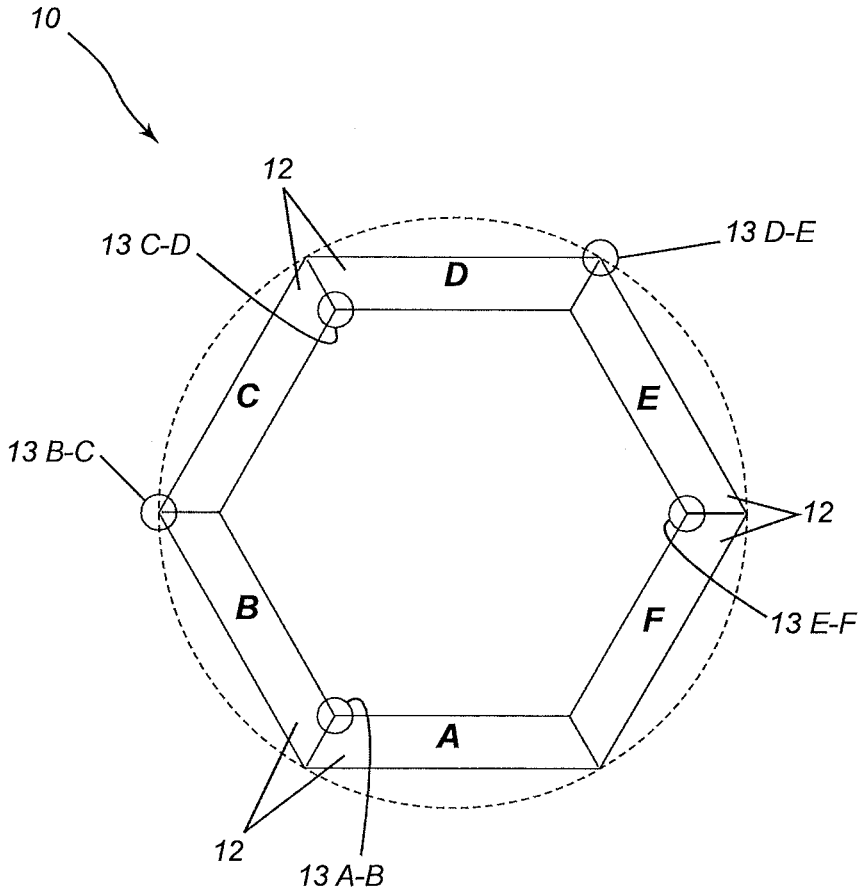
FIG. 9A is a top plan view of the six-sided collapsible aeration system, depicting exemplary angles, dimensions and hinge axes.
Figure 9B:
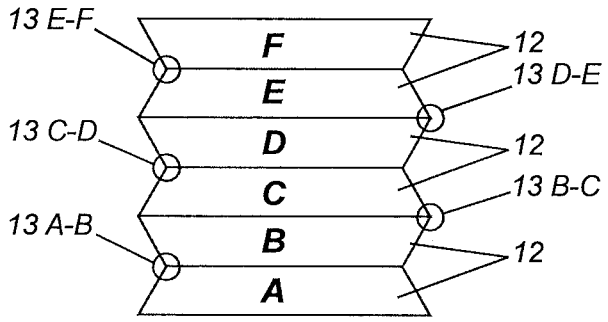
FIG. 9B is a side view of the fully folded collapsible aeration system.

FIG. 9A is a top plan view of the six-sided collapsible aeration system, depicting exemplary angles, dimensions and hinge axes. In this particular exemplary embodiment, the outer surfaces of adjacent duct sections form 60-degree angles as shown in the figure. In this particular example, the outer surfaces are 1'-6" (45.7 cm) wide and the inner surfaces are 1'-3" (38.1 cm) wide. These dimensions are solely presented by way of example and it will be understood the dimensions may be varied without departing from the inventive concept. With these example dimensions, the outer diameter (major diameter) is 3' (91.4 cm). This would be too large to fit into an ordinary manhole on most conventional hoppers. However, the novel collapsible aeration system may be folded into a folded configuration such as the one depicted by way of example in FIG. 9B which is a side view of the fully folded six-section collapsible aeration system of FIG. 9A. When folded, the diameter of the particular embodiment of the aeration system shown in FIG. 9B is only 1'-6" (45.7 cm), which then fits through a conventional 19" (48.3 cm) manhole found on most grain bins. It bears emphasizing that these dimensions are only presented for the purposes of illustration. As will be appreciated, these dimensions may be varied without departing from the inventive concept.

FIG. 9A and FIG. 9B also depict the hinge points or pivot axes of the aerations system's articulated structure. In this example, there are six duct sections 12 and five hinges 13 (i.e. articulating edges or pivotal connections linking the adjoining sections 12). As will be observed, the hinges (articulating edges) alternate between an outer edge and an inner edge. In other words, as depicted in FIG. 9A and FIG. 9B, an edge 13A-B of the outer surface of a first duct (A) is pivotally connected to the common edge 13A-B of the outer surface of a second duct (B). An edge 13B-C of the inner surface of the second duct (B) is pivotally connected to the common edge 13B-C of the inner surface of a third duct (C). An edge 13C-D of the outer surface of the third duct (C) is pivotally connected to the common edge 13C-D of the outer surface of a fourth duct (D). An edge 13D-E of the inner surface of the fourth duct (D) is pivotally connected to the common edge 13D-E of the inner surface of a fifth duct (E). An edge 13E-F of the outer surface of the fifth duct (E) is pivotally connected to the common edge 13E-F of the outer surface of a sixth duct (F). FIG. 9B shows how the edges alternate between inner and outer edges when the aeration system is folded (collapsed) into a stacked configuration. In this example, edges 13A-B, 13C-D and 13E-F are inner edges (because the common edge is along two inner surfaces) whereas edges 13B-C and 13D-E are outer edges (because the common edge is along two outer surfaces).

Figure 10A:
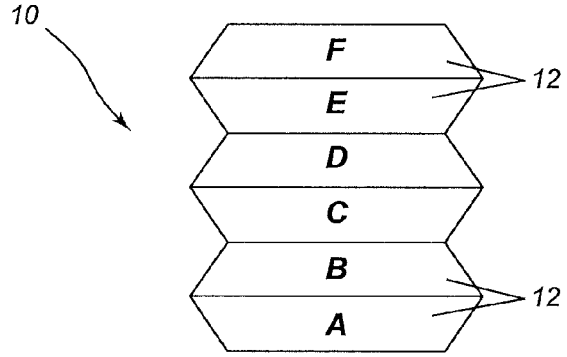
FIG. 10A is a side view of the fully folded collapsible aeration system.
Figure 10B:
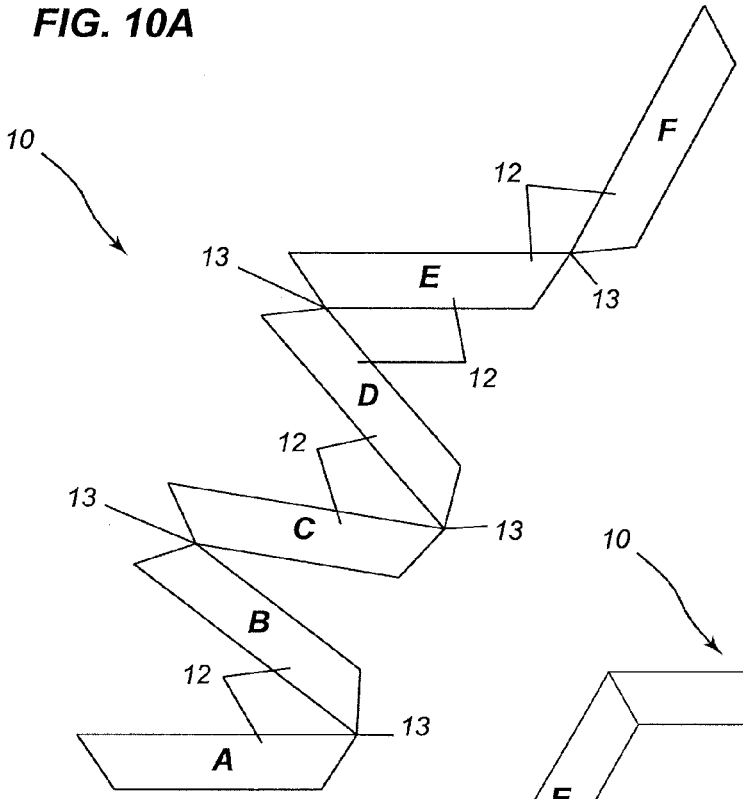
FIG. 10B is a side view of the partially unfolded collapsible aeration system.
Figure 10C:
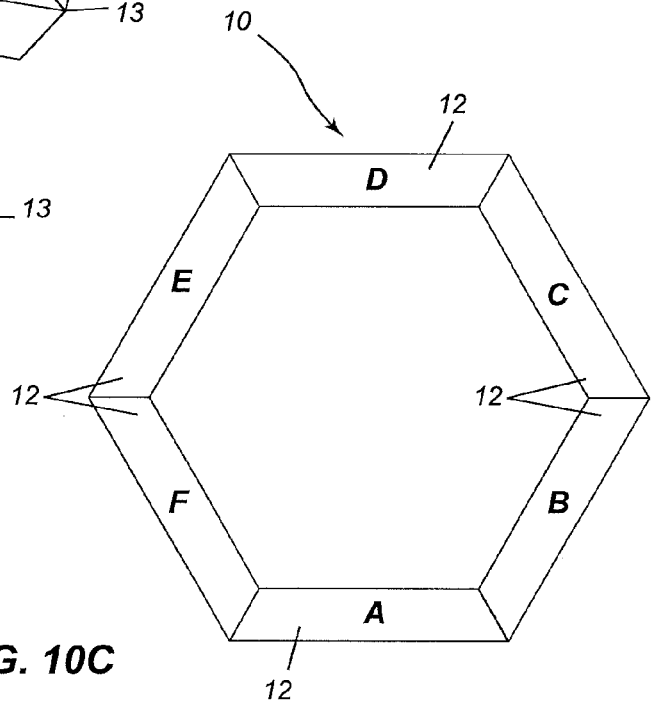
FIG. 10C is a top plan view of the collapsible aeration system.

FIG. 10A, FIG. 10B and FIG. 10C depict the unfolding of the articulated structure of the collapsible aeration system 10. The unfolding process commences at FIG. 10A which shows the stacked (fully folded) six-duct collapsible aeration system 10. FIG. 10B depicts how the collapsible aeration system is unfolded, i.e. how each duct section pivots relative to its adjoining neighbour. The duct sections pivot about each of the edges 13 (which act as hinges or pivots). Once completely unfolded, the collapsible aeration system takes on a hexagonal structure as shown in FIG. 10C in a top plan view. The articulated structure may be folded by reversing this steps, i.e. by pivoting the duct sections 12 about the edges 13 such that the sections are stacked as shown in FIG. 10A.

Figure 11A:
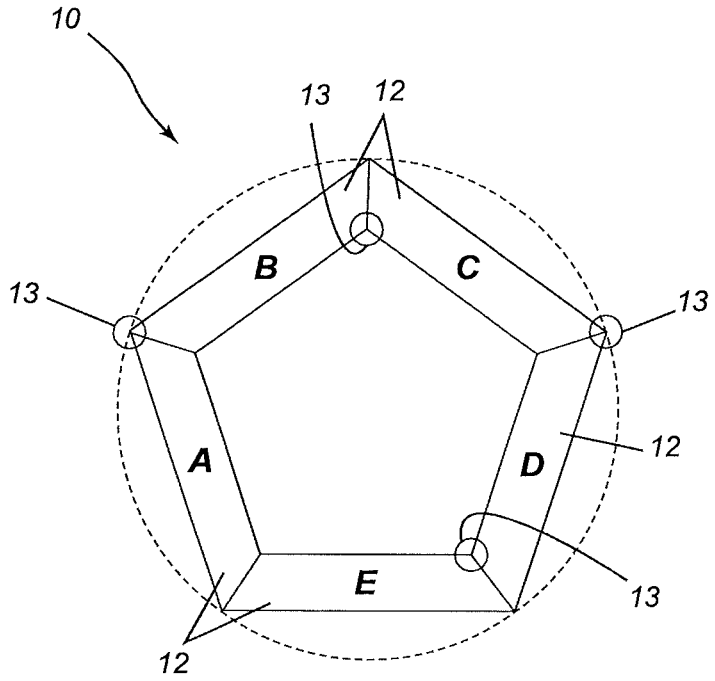
FIG. 11A is a top plan view of a five-sided collapsible aeration system in accordance with another embodiment of the present invention.
Figure 11B:
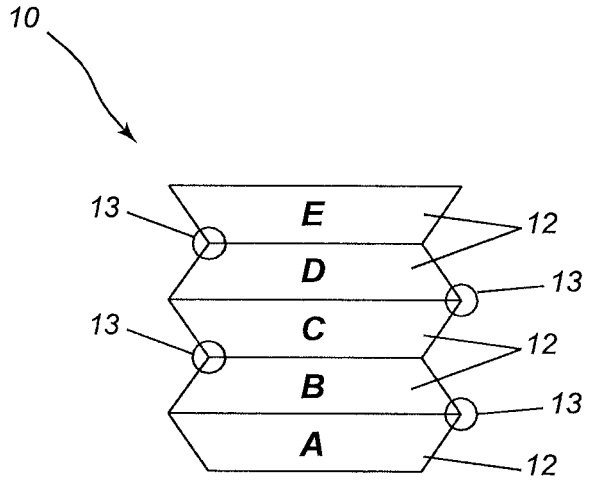
FIG. 11B is a side view of the five-sided collapsible aeration system.

FIG. 11A is a top plan view of a five-section collapsible aeration system 10 in accordance with another embodiment of the present invention. As shown by way of example in FIG. 11A, the unfolded (operative) configuration of the collapsible aeration system 10 is a pentagon (i.e. an articulated structure with five sides). This five-sided aeration system operates analogously to the six-sided version. In other words, it also folds into a stacked configuration shown for example in FIG. 11B. Some dimensions are presented solely by way of example. For example, in the particular embodiment shown in FIG. 11A, the outer surfaces are 1'-6" (45.7 cm) wide. When folded (stacked), as shown by way of example in FIG. 11B, the width of the stacked structure is only 1'-6" (45.7 cm) which thus fits through most conventional manholes in typical grain bins. For this five-sided aeration system (five-ducted dryer), there are four pivots (edges 13). As was the case with the six-sided version, the edges 13 alternate between outer and inner edges. This is apparent from the location of the edges 13 in FIG. 11B.

Figure 12:
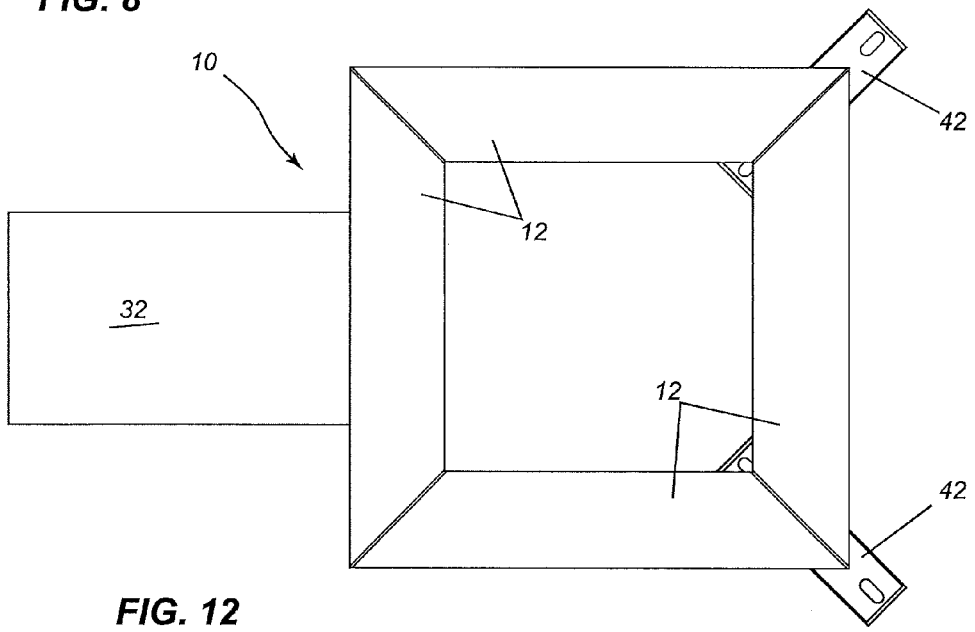
FIG. 12 is a top plan view of a four-sided collapsible aeration system in accordance with another embodiment of the present invention.

FIG. 12 is a top plan view of a four-sided collapsible aeration system 10 in accordance with yet another embodiment of the present invention. In this particular embodiment, there are four ducts 12 that form a square as shown by way of example in FIG. 12. The angled surfaces are at 45-degrees. Again, the articulated structure may be folded into a compact stacked configuration for insertion through a manhole of a grain bin.

Another aspect of the invention is a novel method for retrofitting a hopper of a grain bin with an aeration system. This method entails folding a collapsible aeration system into a compact configuration, e.g. a stacked configuration. The compact configuration is small enough to fit through a manhole or other access hole in the hopper or grain bin. Once the aeration system has been folded, it is inserted in a folded condition into the hopper via a hole in the hopper. Once the aeration system is inside the hopper, the aeration system is unfolded inside the hopper. In main embodiments, the articulated duct sections of the aeration system are unfolded until angled surfaces of one duct abut the angled surfaces of an adjoining duct. The method may then include a step of connecting an air duct to the collapsible aeration system.

From the foregoing, it will be appreciated that a multi-sided structure having flat duct surfaces can be folded in a space-efficient manner for insertion through an opening in a grain bin or equivalent storage structure. Depending on the number of duct sections, when unfolded, these structures may be square, hexagonal, octagonal, etc. in cross-section. The aeration system may also be constructed of multiple curved (rounded) duct sections.

While the aeration system is primarily intended to be folded or collapsed for insertion through a small hole, it should be appreciated that in other embodiments, the aeration system may be inserted as two or more folded subassemblies. For unusually small holes, it may be necessary to insert the duct sections individually and to assemble the system from its constituent duct sections inside the bin or hopper. Assembly of the duct sections may be accomplished using pin connectors, hinges, fasteners, e.g. screws or bolts, or other suitable mechanical connectors. While the duct sections may be permanent connected to one another by riveting, welding, soldering, glue, adhesive, bonding agents, etc., the use of non-permanent fasteners is preferred since this permits the system to be disassembled and removed for servicing, maintenance, overhaul or replacement.

While the above description and accompanying figures disclose how the embodiments of the invention may be used in a hopper or other conically shaped structure, it should be appreciated that the embodiments of the invention may also be used in a flat-bottomed bin or silo. In other words, it should be understood that this invention may be used in any other structure that has a small opening and that requires retrofitting.

Although this invention is primarily intended for retrofitting a grain bin, it should be understood that the same collapsible aeration system can be installed when the grain bin is first manufactured, i.e. a new grain bin can be built with this novel collapsible dryer. After a period of usage, if the collapsible aeration system requires maintenance, repair or replacement, it can easily be folded (collapsed) and removed from the bin (by extricating the folded aeration system through an opening in the bin). After maintenance or repair, the aeration system is re-inserted into the grain bin. Similarly, if a new system is required because the existing one is broken or defective, the old system is simply folded and removed and the new system, in its collapsed state, is inserted into the bin, unfolded and installed.

The embodiments of the invention described above are intended to be exemplary only. As will be appreciated by those of ordinary skill in the art, to whom this specification is addressed, many obvious variations, modifications, and refinements can be made to the embodiments presented herein without departing from the spirit and scope of the invention. The scope of the exclusive right sought by the applicant(s) is therefore intended to be limited solely by the appended claims.

What is claimed is:

1. An aeration system for retrofitting a grain bin, the collapsible aeration system comprising:

a plurality of trapezoidal duct sections, each of the duct sections comprising an outer surface having air openings, wherein each of the plurality of duct sections has a flat outer surface, a flat inner surface narrower than the outer surface, and first and second flat angled surfaces connecting the inner and outer surfaces, the duct sections each defining an internal air space, wherein the duct sections are connected together by abutting the first angled surface of each duct section with the second angled surface of an adjoining duct section; and an air duct disposed in the outer surface of one of the duct sections, the air duct connectable to an air inlet in the grain bin for delivering air through the air openings into the grain bin for aerating grain in the grain bin.

2. The system as claimed in claim 1 wherein the duct sections are pivotally connected.

3. The system as claimed in claim 1 wherein the duct sections are configured to be assembled together using fasteners and further configured to be disassembled by unfastening the fasteners.

4. The system as claimed in claim 2 comprising a plurality of pivoting connections along adjoining edges of the duct sections for pivotally connecting adjacent pairs of the duct sections to thereby enable the aeration system to be folded and unfolded.

5. The system as claimed in claim 1 further comprising a plurality of legs for supporting the system inside the grain bin.

6. The system as claimed in claim 5 wherein each of the plurality of legs comprises a triangular foot pivotally for engaging a sloped inner surface.

7. The system as claimed in claim 1 wherein the outer surface of each of the duct sections is curved to form a round duct when unfolded.

8. The system as claimed in claim 1 comprising an air manifold that caps the duct sections.

9. A retrofit aeration system for a grain bin, the system comprising:

a plurality of trapezoidal duct sections, each of the duct sections comprising an outer surface having air openings and an inner surface joined together by first and second angled surfaces, the duct sections each defining an internal air space, wherein the duct sections are connected together by abutting the first angled surface of each duct section with the second angled surface of an adjacent duct section; and an air manifold on all of the duct sections to permit air to flow between the duct sections.

10. The system as claimed in claim 9 further comprising an air duct disposed in the outer surface of one of the duct sections, the air duct connected to an air inlet in the grain bin for delivering air through the air openings into the grain bin for aerating grain in the grain bin.

11. The system as claimed in claim 9 wherein the outer surface is a flat outer surface and wherein the inner surface is a flat inner surface narrower than the outer surface.

12. The system as claimed in claim 9 further comprising a plurality of legs for supporting the duct sections inside the grain bin.

13. The system as claimed in claim 12 wherein each of the plurality of legs comprises a triangular foot pivotally for engaging a sloped inner surface of the grain bin.

14. An aeration retrofit system for retrofitting a grain bin having a hopper to aerate grain that is stored inside the grain bin, the system comprising:

a plurality of trapezoidal duct sections defining airways and having air openings for aerating the grain, the duct sections having angled side surfaces to abut adjacent duct sections to surround a discharge chute of the grain bin;

an air manifold capping the duct sections to provide air flow between the duct sections; and an air duct disposed in the outer surface of one of the duct sections, the air duct connectable to an air inlet in the grain bin for delivering air through the air openings into the grain bin for aerating grain in the grain bin.

15. The system as claimed in claim 14 wherein the duct sections are supported by legs above the hopper.

16. The system as claimed in claim 15 wherein the legs each comprise a foot that pivotally engages a sloped inner surface of the hopper.

17. The system as claimed in claim 14 wherein the duct sections form a six-sided collapsible aeration system, wherein each duct section is hinged to an adjacent duct section to be collapsed for insertion into the grain bin.

18. The system as claimed in claim 17 wherein the collapsible aeration system, when collapsed, fits through a manhole of a grain bin.

19. The system as claimed in claim 18 wherein the duct sections fold into a stacked configuration.

20. The system as claimed in claim 1 comprising six duct sections.

* * * * *